US011232741B2

(12) United States Patent
Hyun et al.

(10) Patent No.: US 11,232,741 B2
(45) Date of Patent: Jan. 25, 2022

(54) PIXEL AND DISPLAY DEVICE HAVING THE SAME

(71) Applicant: Samsung Display Co., Ltd., Yongin-si (KR)

(72) Inventors: Chae Han Hyun, Yongin-si (KR); Ah Young Kim, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/024,362

(22) Filed: Sep. 17, 2020

(65) Prior Publication Data

US 2021/0225266 A1 Jul. 22, 2021

(30) Foreign Application Priority Data

Jan. 16, 2020 (KR) ..... 10-2020-0006121

(51) Int. Cl.
*G09G 3/32* (2016.01)

(52) U.S. Cl.
CPC ..... *G09G 3/32* (2013.01); *G09G 2300/0842* (2013.01); *G09G 2330/023* (2013.01)

(58) Field of Classification Search
None
See application file for complete search history.

(56) References Cited

U.S. PATENT DOCUMENTS 8,274,503 B2 9/2012 Kwon
10,446,079 B2 10/2019 Ka et al.
2011/0157126 A1* 6/2011 Chung ..... G09G 3/3233 345/211
2014/0139408 A1* 5/2014 Kim ..... G09G 3/3233 345/76
2014/0292827 A1* 10/2014 Kang ..... G09G 3/3233 345/690
2015/0130859 A1* 5/2015 Yang ..... G09G 3/3233 345/690
2018/0166516 A1* 6/2018 Chai ..... H01L 27/32
2019/0147799 A1 5/2019 Kim et al.
2021/0134210 A1 5/2021 In et al.
2021/0201764 A1 7/2021 Oh et al.

FOREIGN PATENT DOCUMENTS

KR 10-2018-0004370 A 1/2018
KR 10-2019-0055301 A 5/2019
KR 10-2021-0054114 A 5/2021

* cited by examiner

*Primary Examiner* — Chad M Dicke
(74) *Attorney, Agent, or Firm* — Lewis Roca Rothgerber Christie LLP

(57) ABSTRACT

A display device includes pixels, a scan driver, an emission driver, and a data driver. A pixel of an i-th horizontal line includes a light emitting element, a first transistor including a first electrode connected to a first node, a second transistor including a gate electrode connected to an (i+x)-th emission control line and connected to one of the data lines, a third transistor including a gate electrode connected to an (i+y)-th emission control line, and connected between the second transistor and the first node, a fourth transistor connected between a third node connected to a second electrode of the first transistor and a second node, and turned on by a scan signal supplied to an i-th scan line, and a fifth transistor connected between the first power and the first node, and turned off by the emission control signal supplied to an i-th emission control line.

19 Claims, 12 Drawing Sheets

SECOND DRIVING FREQUENCY

PIXEL AND DISPLAY DEVICE HAVING THE SAME

CROSS-REFERENCE TO RELATED APPLICATION

The present application claims priority to and the benefit of Korean Patent Application No. 10-2020-0006121, filed on Jan. 16, 2020, the content of which in its entirety is herein incorporated by reference.

BACKGROUND

Field

Aspects of some example embodiments of the present disclosure relate to a display device.

Description of the Related Art

Display devices are utilized to display images on a display panel using control signals applied from an external source.

A display device generally includes a plurality of pixels. Each of the pixels may include a plurality of transistors, and a light emitting element and a capacitor electrically connected to the transistors. The transistors are turned on in response to signals provided through a line, respectively, to generate a driving current, and the light emitting element emits light in correspondence with the driving current.

A display device corresponding to various driving frequencies may be utilized for high resolution driving, low power driving, stereoscopic image driving, and the like. For example, a pixel structure including and combining a polysilicon semiconductor transistor and an oxide semiconductor transistor in one pixel may be utilized.

The above information disclosed in this Background section is only for enhancement of understanding of the background and therefore the information discussed in this Background section does not necessarily constitute prior art.

SUMMARY

Aspects of some example embodiments of the present disclosure relate to a display device, and for example, to a pixel and a display device including the same.

Aspects of some example embodiments may include a pixel that writes a data signal in response to an emission control signal.

Aspects of some example embodiments may include a display device including the pixel.

However, embodiments according to the present disclosure are not limited to the above-described characteristics, and may be variously expanded within a range without departing from the spirit and scope of embodiments according to the present disclosure.

A display device according to some example embodiments of the disclosure may include pixels connected to scan lines, emission control lines, and data lines, a scan driver configured to supply scan signals to the scan lines, an emission driver configured to supply emission control signals to the emission control lines, and a data driver configured to supply data signals to the data lines in correspondence with the scan signal. A pixel positioned in an i-th (where, i is a natural number) horizontal line may include a light emitting element, a first transistor including a first electrode connected to a first node electrically connected to first power, and controlling a driving current based on a voltage of a second node, a second transistor including a gate electrode connected to an (i+x)-th (where, x is an integer) emission control line and connected to one of the data lines, a third transistor including a gate electrode connected to an (i+y)-th (where, y is an integer that is not zero and different from x) emission control line, and connected between the second transistor and the first node, a fourth transistor connected between a third node connected to a second electrode of the first transistor and the second node, and turned on by the scan signal supplied to an i-th scan line, and a fifth transistor connected between the first power and the first node, and turned off by an emission control signal supplied to an i-th emission control line.

According to some example embodiments, the second transistor and the third transistor may be different types.

According to some example embodiments, the second transistor may be an N-type transistor including an oxide semiconductor layer, and the third transistor may be a P-type transistor including a polysilicon semiconductor layer.

According to some example embodiments, the second transistor may be turned on by an emission control signal supplied to the (i+x)-th emission control line, and the third transistor may be turned off by an emission control signal supplied to the (i+y)-th emission control line.

According to some example embodiments, the emission driver may supply the emission control signal to the (i+x)-th emission control line after supplying the emission control signal to the i-th emission control line, and may supply the emission control signal to the (i+y)-th emission control line after supplying the emission control signal to the (i+x)-th emission control line.

According to some example embodiments, the emission driver may supply the emission control signal to the (i+x)-th emission control line after supplying the emission control signal to the (i+y)-th emission control line, and may supply the emission control signal to the i-th emission control line after supplying the emission control signal to the (i+x)-th emission control line.

According to some example embodiments, the emission driver may simultaneously supply the emission control signal to the i-th emission control line and the (i+x)-th emission control line, and may supply the emission control signal to the (i+y)-th emission control line after supplying the emission control signal to the (i+x)-th emission control line.

According to some example embodiments, the pixel positioned in the i-th horizontal line may further include a sixth transistor connected between the third node and a first electrode of the light emitting element, and turned off by the emission control signal supplied to the i-th emission control line, and a seventh transistor connected between the second node and a first initialization power, and turned on by a scan signal supplied to an (i−1)-th scan line.

According to some example embodiments, the pixel positioned in the i-th horizontal line may further include an eighth transistor coupled between second initialization power and the first electrode of the light emitting element, and turned on by the emission control signal supplied to the i-th emission control line.

According to some example embodiments, the fourth, seventh, and eighth transistors may be N-type transistors including an oxide semiconductor layer, and the fifth and sixth transistors may be p-type transistors including a polysilicon semiconductor layer.

According to some example embodiments, the second transistor may be a P-type transistor including a polysilicon semiconductor layer, and the third transistor may be an N-type transistor including an oxide semiconductor layer.

A pixel according to some example embodiments of the disclosure may include a light emitting element, a first transistor including a first electrode connected to a first node electrically connected to first power, and controlling a driving current based on a voltage of a second node, a second transistor including a gate electrode connected to a first emission control line and connected to a data line, a third transistor including a gate electrode connected to a second emission control line, and connected between the second transistor and the first node, a fourth transistor connected between a third node connected to a second electrode of the first transistor and the second node, and turned on by a scan signal supplied to a first scan line, a fifth transistor connected between the first power and the first node, and turned off by an emission control signal supplied to a third emission control line, a sixth transistor connected between the third node and a first electrode of the light emitting element, and turned off by the emission control signal supplied to the third emission control line, and a storage capacitor connected between the first power and the second node.

According to some example embodiments, the second transistor and the third transistor may be different types.

According to some example embodiments, the second transistor may be an N-type transistor including an oxide semiconductor layer, and the third transistor may be a P-type transistor including a polysilicon semiconductor layer.

According to some example embodiments, the second transistor may be turned on by the emission control signal supplied to the first emission control line, and the third transistor may be turned off by the emission control signal supplied to the second emission control line.

According to some example embodiments, a data signal may be supplied to the first transistor through the data line as the second transistor, the third transistor, and the fourth transistor are simultaneously turned on.

According to some example embodiments, the pixel may further include a seventh transistor connected between the second node and a first initialization power, and turned on by the scan signal supplied to a second scan line.

According to some example embodiments, the pixel may further include an eighth transistor coupled between second initialization power and the first electrode of the light emitting element, and turned on by the emission control signal supplied to the third emission control line, the eighth transistor may be an N-type transistor including an oxide semiconductor layer, and the fifth and sixth transistors may be P-type transistors including a polysilicon semiconductor layer.

According to some example embodiments, the fourth and seventh transistors may be the N-type transistors.

According to some example embodiments, the pixel may further include an eighth transistor coupled between second initialization power and the first electrode of the light emitting element, and turned on by the scan signal supplied to the first scan line or the second scan line.

The pixel including N-type and P-type transistors, and the display device including the same according to some example embodiments of the disclosure may use the emission control signal to control the second and third transistors used for writing a data signal. Therefore, a scan driver configuration for driving the P-type transistor may be removed. Thus, a dead space and power consumption of the display device may be greatly reduced compared to alternative configurations or structures.

However, characteristics of embodiments according to the disclosure are not limited to the above-described characteristics, and may be variously expanded within a range without departing from the spirit and scope of embodiments according to the disclosure.

BRIEF DESCRIPTION OF THE DRAWINGS

The above and other characteristics of embodiments according to the disclosure will become more apparent by describing in further detail aspects of some example embodiments thereof with reference to the accompanying drawings, in which.

DETAILED DESCRIPTION

Figure 1:
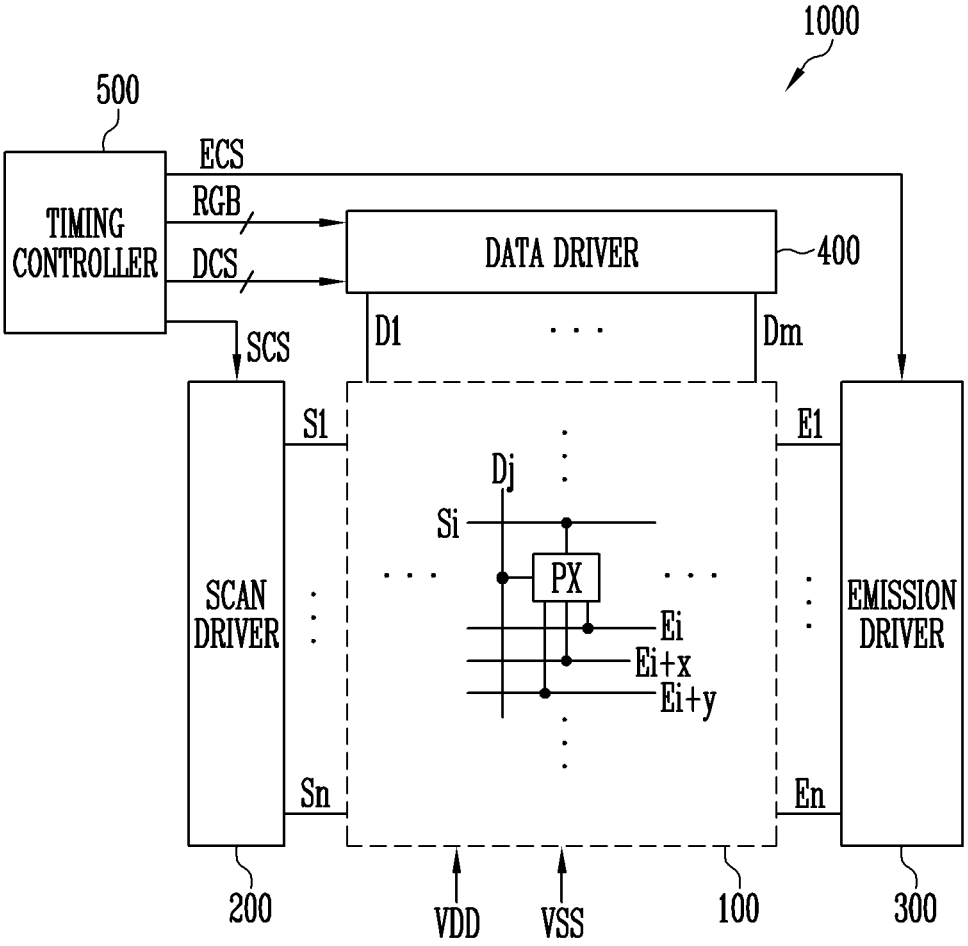
FIG. 1 is a block diagram illustrating a display device according to some example embodiments of the disclosure.

Hereinafter, further details of some example embodiments of the disclosure will be described in more detail with reference to the accompanying drawings. The same reference numerals are used for the same components in the drawings, and some repetitive description of the same components may be omitted.

FIG. 1 is a block diagram illustrating a display device according to some example embodiments of the disclosure.

Referring to FIG. 1, the display device 1000 may include a pixel unit 100, a scan driver 200, an emission driver 300, a data driver 400, and a timing controller 500.

The display device 1000 may display an image at various driving frequencies (or image refresh rate or screen refresh rate) according to a driving condition. The driving frequency is a frequency at which a data signal is substantially written to a driving transistor of a pixel PX. For example, the driving frequency is also referred to as the refresh rate and the screen refresh rate, and indicates a frequency at which a display screen is reproduced for one second.

According to some example embodiments, the display device 1000 may adjust an output frequency of the scan driver 200 and an output frequency of the data driver 400 corresponding thereto according to the driving condition. For example, the display device 1000 may display an image in correspondence with various driving frequencies of 1 Hz to 120 Hz.

The pixel unit 100 may include a plurality of scan lines S1 to Sn, a plurality of emission control lines E1 to En, and a plurality of data lines D1 to Dm, and include a plurality of pixels PX connected to the scan lines S1 to Sn, the emission control lines E1 to En, and the data lines D1 to Dn, respectively (where m and n are integers greater than 1). Each of the pixels PX may include a driving transistor and a plurality of switching transistors.

The timing controller 500 may generate a scan driving control signal SCS, an emission driving control signal ECS, and a data driving control signal DCS in correspondence with synchronization signals supplied from the outside. The scan driving control signal SCS may be supplied to the scan driver 200, the emission driving control signal ECS may be supplied to the emission driver 300, and the data driving control signal DCS may be supplied to the data driver 400. In addition, the timing controller 500 may rearrange image data RGB supplied from the outside and supply the rearranged image data RGB to the data driver 400.

The scan driving control signal SCS may include a scan start pulse and clock signals. The scan start pulse may control a first timing of the scan signal. The clock signals may be used to shift the scan start pulse.

The emission driving control signal ECS may include an emission control start pulse and clock signals. The emission control start pulse may control a first timing of the scan signal. The clock signals may be used to shift the emission control start pulse.

The data driving control signal DCS may include a source start pulses and clock signals. The source start pulse controls a sampling start time point of data. The clock signals are used to control a sampling operation.

The scan driver 200 may receive the scan driving control signal SCS from the timing controller 500, and supply the scan signal to the scan lines S1 to Sn based on the scan driving control signal SCS. For example, the scan driver 200 may sequentially supply the scan signals to the scan lines S1 to Sn. The scan signal may be set to a gate on voltage (for example, a high voltage). A transistor included in the pixel PX and receiving the scan signal may be set to a turn-on state when the scan signal is supplied. Hereinafter, a situation in which the scan signal has a high voltage (a situation where a pulse of a high level of the scan signal is applied) will be described as a situation where the scan signal is supplied.

Meanwhile, the scan driver 200 may control the scan signal supplied to the scan lines S1 to Sn in correspondence with the driving frequency.

The emission driver 300 may receive the emission driving control signal ECS from the timing controller 500, and supply an emission control signal to the emission control lines E1 to En based on the emission driving control signal ECS. For example, the emission driver 300 may sequentially supply the emission control signal to the emission control lines E1 to En.

The emission control signal may be set to a gate off voltage (for example, a high voltage). Hereinafter, a situation in which the emission control signal has a high voltage (a situation where a pulse of a high level of the emission control signal is applied) will be described as a situation where the emission control signal is supplied.

The emission control signal may be utilized to control an emission time of the pixels PX. To this end, the emission control signal may be set to a width wider than that of the scan signal. For example, the scan driver 200 may supply a scan signal to an (i−1)-th scan line Si−1 and an i-th scan line Si so as to overlap the emission control signal supplied to an i-th emission control line Ei (i is a natural number equal to or less than n).

According to some example embodiments, the pixels PX may be selected in a horizontal line unit (or pixel row unit) in response to supply of the emission scan signal.

According to some example embodiments, the emission driver 300 may supply the emission control signal to the emission control lines E1 to En in correspondence with a maximum driving frequency of the display device 1000. For example, an output frequency at which the emission driver 300 outputs the emission control signal may be constant regardless of the driving frequency (or image frame rate) and change.

Each of the scan driver 200 and the emission driver 300 may be mounted on a substrate through a thin film process. In addition, the scan driver 200 may be positioned at both sides with the pixel unit 100 interposed therebetween. The emission driver 300 may also be positioned at both sides with the pixel unit 100 interposed therebetween.

In addition, in FIG. 1, the scan driver 200 and the emission driver 300 supply the scan signal and the emission control signal, respectively, but embodiments according to the disclosure are not limited thereto. For example, the scan signal and the emission control signal may be supplied by one driver.

The data driver 400 may receive the data driving control signal DCS and the image data RGB from the timing controller 500. The data driver 400 may supply a data signal to the data lines D1 to Dm in correspondence with the data driving control signal DCS. The data signal supplied to the data lines D1 to Dm may be supplied to the pixels PX selected by the emission control signals. To this end, the data driver 400 may supply the data signal to the data lines D1 to Dm in synchronization with the scan signal.

Meanwhile, n scan lines S1 to Sn and n emission control lines E1 to En are shown in FIG. 1, but embodiments according to the disclosure are not limited thereto. For example, the pixels PX positioned in a current horizontal line (or a current pixel row) in correspondence with a circuit structure of the pixels PX may be additionally connected to a scan line positioned in a previous horizontal line (or a previous pixel row) and/or a scan line positioned in a subsequent horizontal line (or a subsequent pixel row). To this end, dummy scan lines and/or dummy emission control lines (not shown) may be additionally formed in the pixel unit 100.

Figure 2A:
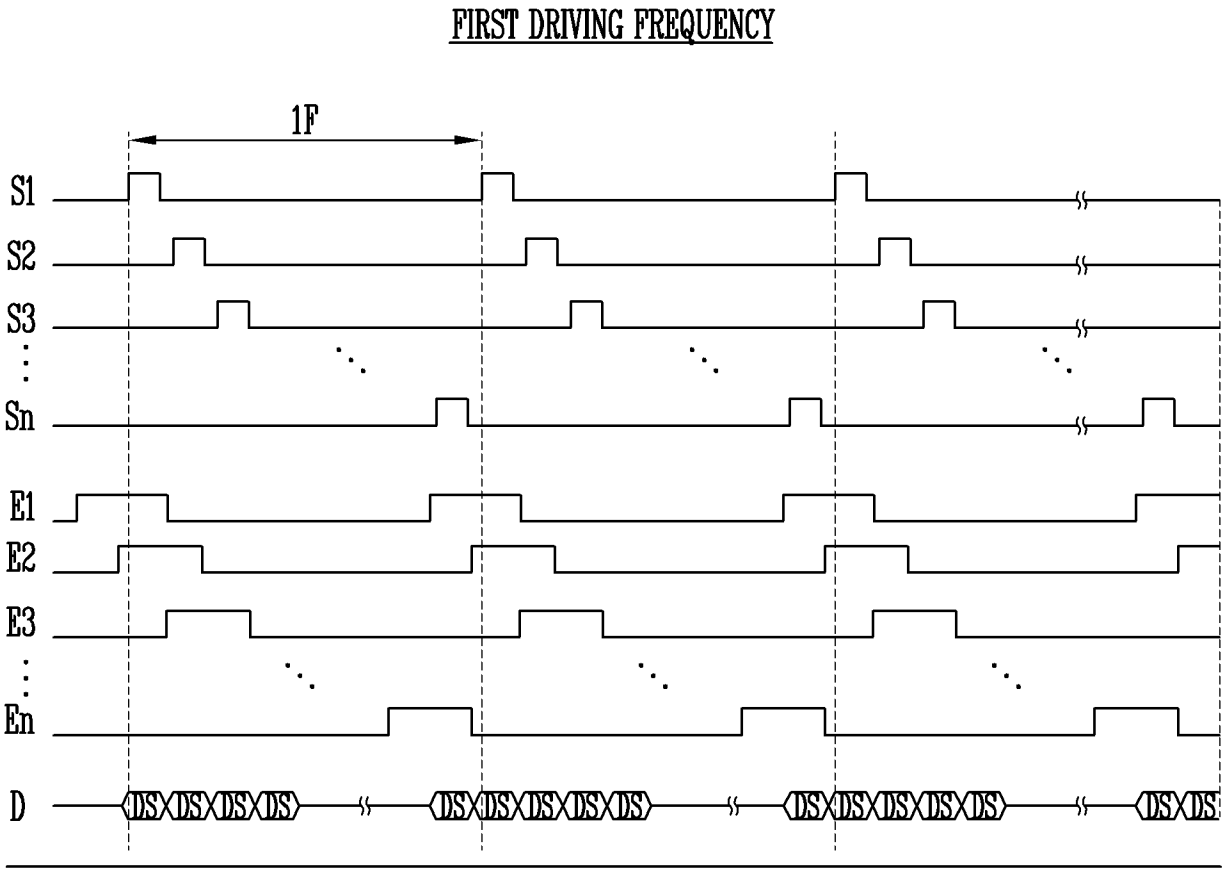
FIG. 2A is a timing diagram illustrating an example of a method of driving the display device of FIG. 1.

FIG. 2A is a timing diagram illustrating an example of a method of driving the display device of FIG. 1.

FIG. 2A illustrates an example of a driving method when the display device 1000 of FIG. 1 is driven at a first driving frequency. For example, the first driving frequency may be set to 60 Hz or 120 Hz. The first driving frequency is a driving frequency (or image refresh rate) applied by the display device 1000 to display a general image.

Referring to FIGS. 1 and 2A, the scan signal is sequentially supplied to the scan lines S1 to Sn during one frame period 1F when the display device is driven at the first driving frequency.

When the display device is driven at the first driving frequency, the emission control signal is sequentially supplied to the emission control lines E1 to En during one frame period 1F. Here, the emission control signal supplied to the i-th emission control line Ei overlaps the scan signal supplied to the (i−1)-th scan line Si−1 and the i-th scan line Si. The data signal DS is supplied to the data lines D so as to be synchronized with the scan signal. However, this is merely an example, and the emission control signal may have a length of 7 horizontal periods or more, and may overlap the scan signals supplied to an (i−3)-th to (i+3)-th scan lines Si−3 to Si+3.

The pixels PX emit light in correspondence with the data signal DS, and an image may be displayed in the pixel unit 100.

Figure 2B:
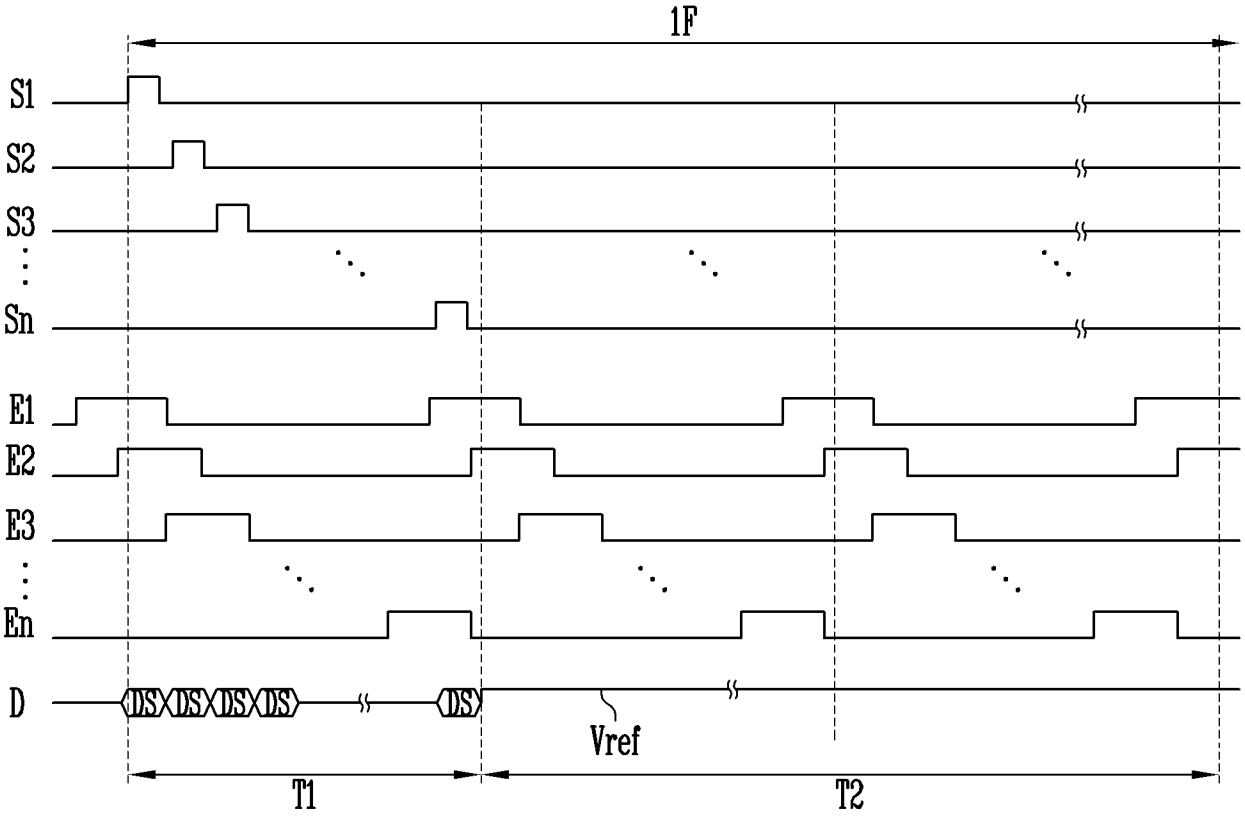
FIG. 2B is a timing diagram illustrating another example of a method of driving the display device of FIG. 1.

FIG. 2B is a timing diagram illustrating another example of a method of driving the display device of FIG. 1.

FIG. 2B illustrates an example of a driving method when the display device 1000 of FIG. 1 is driven at a second driving frequency. For example, the second drive frequency may be set to a low frequency less than 60 Hz. The second driving frequency is a driving frequency applied to display an image in a standby mode (for example, an always on display (AOD) mode) of the display device 1000.

Referring to FIGS. 1 and 2B, a frame period 1F in which image data is refreshed (or the data signal is supplied to the pixel) when the display device is driven at the second driving frequency is divided into a first driving period T1 and a second driving period T2. Here, the second driving period T2 may be longer than or equal to the first driving period T1.

For example, when the second driving frequency is 30 Hz and the frequency at which the emission control signal is supplied is 60 Hz, a length of the first driving period T1 and a length of the second driving period T2 may be substantially the same. Alternatively, when the second driving frequency is 1 Hz and the frequency at which the emission control signal is supplied is 60 Hz, the length of the second driving period T2 may be about 59 times the length of the first driving period T1. That is, the length of the second driving period T2 may be equal to a time in which the first driving period T1 is repeated 59 times.

The scan signals supplied to the i-th scan line Si and the data signal DS corresponding thereto may be supplied at substantially the same period as the second driving frequency.

The scan signal is sequentially supplied to the scan lines S1 to Sn during the first driving period T1. In addition, the emission control signal is sequentially supplied to the emission control lines E1 to En during the first driving period T1. Here, the emission control signal supplied to the i-th emission control line Ei overlaps the scan signal supplied to the (i−1)-th scan line Si−1 and the i-th scan line Si.

The data signal DS is supplied to the data lines D so as to be synchronized with the scan signal. The data signal DS supplied to an i-th horizontal line may be supplied at substantially the same period as the second driving frequency.

The scan signal is not supplied to the scan lines S1 to Sn during the second driving period T2. However, in the second driving period T2, the emission control signal is supplied to the emission control lines E1 to En a plurality of times. For example, when the second driving frequency is 1 Hz, the emission control signal is supplied to the i-th emission control line Ei once during the first driving period T1, and the emission control signal may be supplied to the i-th emission control line Ei 59 times during the second driving period T2.

Meanwhile, a voltage of a reference power Vref is supplied to the data lines D during the second driving period T2. For example, the voltage of the reference power Vref may have a voltage level capable of applying on-bias to the driving transistor of the pixel PX. However, this is merely an example, and a magnitude of the voltage supplied to the data lines D during the second driving period T2 may be determined according to a characteristic of the display device 1000, and may vary over a frame or a time.

In a situation of a low frequency driving to which the second driving frequency (for example, 1 Hz driving frequency) is applied, an image corresponding to the data signal DS may be displayed for a relatively long time after applying the data signal DS once. In addition, because the scan signal is not supplied to the scan lines S1 to Sn in the second driving period T2 (that is, because the number of toggling of the scan signal at the second driving frequency is reduced), power consumption in the low frequency driving may be reduced.

Figure 3:
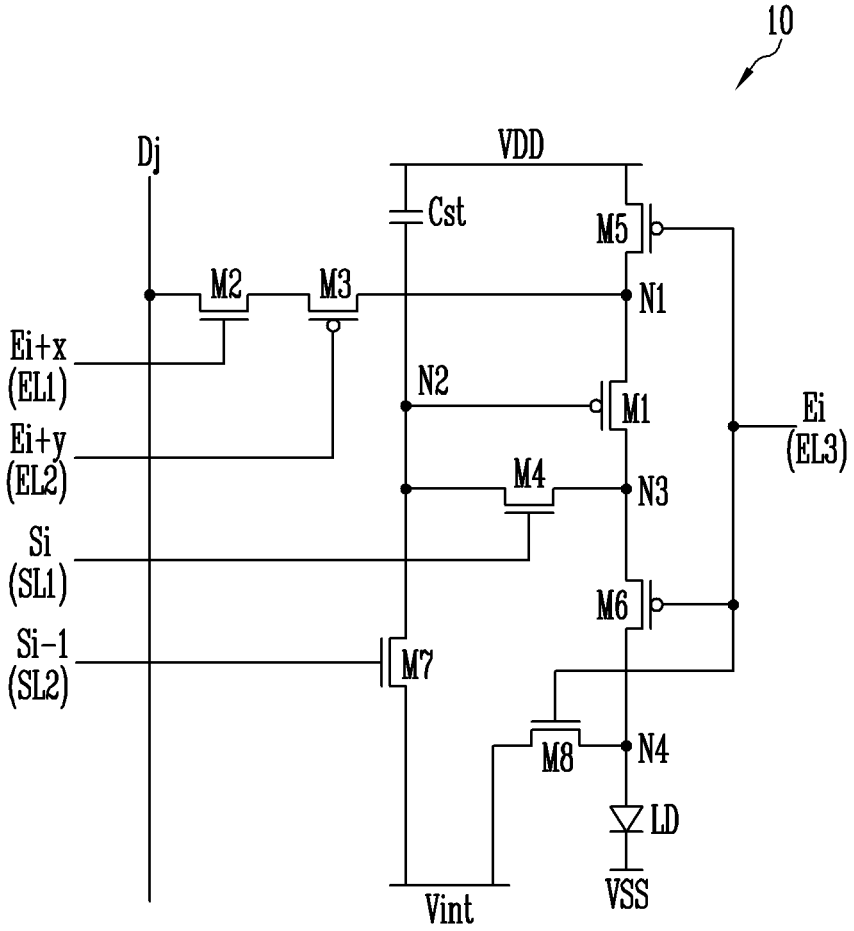
FIG. 3 is a circuit diagram illustrating the pixel according to some example embodiments of the disclosure.

FIG. 3 is a circuit diagram illustrating the pixel according to some example embodiments of the disclosure.

In FIG. 3, for convenience of description, the pixel 10 positioned in the i-th horizontal line and connected to a j-th data line Dj is illustrated.

Referring to FIG. 3, the pixel 10 may include a light emitting element LD, first to eighth transistors M1 to M8, and a storage capacitor Cst.

A first electrode (anode electrode or cathode electrode) of the light emitting element LD is connected to a fourth node N4 and a second electrode (cathode electrode or anode electrode) is connected to second power VSS. The light emitting element LD generates light of a luminance (e.g., a set or predetermined luminance) in correspondence with an amount of current supplied from the first transistor M1.

According to some example embodiments, the light emitting element LD may be an organic light emitting diode including an organic light emitting layer. According to some example embodiments, the light emitting element LD may be an inorganic light emitting element formed of an inorganic material. Alternatively, the light emitting element LD may have a form in which a plurality of inorganic light emitting elements are connected in parallel and/or in series between the second power VSS and the fourth node N4.

A first electrode of the first transistor M1 (or the driving transistor) may be connected to a first node N1, and a second electrode may be connected to a third node N3. A gate electrode of the first transistor M1 may be connected to a second node N2. The first transistor M1 may control the amount of current flowing from first power VDD to the second power VSS via the light emitting element LD in response to a voltage of the second node N2. To this end, the first power VDD may be set to a voltage higher than that of the second power VSS.

The second transistor M2 may be connected between the data line Dj and the third transistor M3. A gate electrode of the second transistor M2 may be connected to an (i+x)-th (where, x is an integer) emission control line Ei+x (or a first emission control line EL1). The second transistor M2 may be turned on when the emission control signal is supplied (that is, when a high voltage of the emission control signal is supplied) to the (i+x)-th emission control line Ei+x.

According to some example embodiments, the second transistor M2 may be formed of an oxide semiconductor transistor. The second transistor M2 may include an oxide semiconductor layer as an active layer (channel). In addition, the second transistor M2 may be an N-type oxide semiconductor transistor, and thus a gate-on voltage for turning on the second transistor M2 may be a high voltage (logic high level).

The third transistor M3 is connected between the second transistor M2 and the first node N1. A gate electrode of the third transistor M3 may be connected to an (i+y)-th (where, y is an integer that is not zero and different from x) emission control line Ei+y (or a second emission control line EL2). The third transistor M3 may be turned off when the emission control signal is supplied to the (i+y)-th emission control line Ei+y. In other words, the third transistor M3 may be turned on when the emission control signal is not supplied (that is, when a low voltage of the emission control signal is supplied).

According to some example embodiments, the third transistor M3 may be formed of a polysilicon transistor. The second transistor M2 may include a polysilicon semiconductor layer as an active layer (channel). For example, the active layer of the second transistor M2 may be formed through a low temperature polysilicon process (for example, a low-temperature poly-silicon process).

In addition, the third transistor M3 may be a P-type polysilicon semiconductor transistor, and thus a gate-on voltage for turning on the third transistor M3 may be a low voltage (logic low level).

As described above, the second transistor M2 and the third transistor M3 may be connected in series between the data line Dj and the first node N1. In addition, the second transistor M2 and the third transistor M3 may be transistors of different types. Therefore, the second transistor M2 and the third transistor M3 are turned on by different voltage levels.

As shown in FIG. 3, the emission control signal may be supplied to the gate electrodes of the respective second transistor M2 and third transistor M3 at different timings. Therefore, a period in which the emission control signal is supplied to the first emission control line EL1 and a period in which the emission control signal is not supplied to the second emission control line EL2 may overlap. Therefore, a period in which the second transistor M2 and the third transistor M3 are simultaneously (or concurrently) turned on may be determined.

In the period in which the second transistor M2 and the third transistor M3 are simultaneously (or concurrently) turned on, the data signal supplied to the data line Dj may be transferred to the first node N1.

The fourth transistor M4 may be connected between the second electrode of the first transistor M1 (that is, the third node N3) and the second node N2. A gate electrode of the fourth transistor M4 may be connected to the i-th scan line Si (or a first scan line SL1). The fourth transistor M4 is turned on when the scan signal is supplied to the i-th scan line Si to electrically connect the second electrode of the first transistor M1 and the second node N2 to each other. Therefore, when the fourth transistor M4 is turned on, the first transistor M1 is connected in a form of a diode.

The fifth transistor M5 may be connected between the first power VDD and the first node N1. A gate electrode of the fifth transistor M5 may be connected to the emission control line Ei (or a third emission control line EL3.) The fifth transistor M5 is turned off when the emission control signal is supplied to the emission control line Ei and turned on in other cases.

The sixth transistor M6 may be connected between the second electrode of the first transistor M1 (that is, the third node N3) and the first electrode of the light emitting element LD (that is, the fourth node N4). A gate electrode of the sixth transistor M6 may be connected to the emission control line Ei. The sixth transistor M6 is turned off when the emission control signal is supplied to the emission control line Ei and turned on in other cases.

According to some example embodiments, the fifth and sixth transistors M5 and M6 may be P-type polysilicon semiconductor transistors.

Meanwhile, the above-described first to third emission control lines EL1 to EL3 may mean that the same emission control signal is supplied at different timings through different emission control lines. Similarly, the first and second scan lines SL1 and SL2 may mean that the same scan signal is supplied at different timings through different scan lines.

The seventh transistor M7 may be connected between the second node N2 and initialization power Vint. A gate electrode of the seventh transistor M7 may be connected to the (i−1)-th scan line Si−1 (or a second scan line SL2). The seventh transistor M7 is turned on when the scan signal is supplied to the (i−1)-th scan line Si−1 to supply a voltage of the initialization power Vint to the second node N2.

According to some example embodiments, the voltage of the initialization power Vint is set to a voltage lower than the data signal supplied to the data line Dj. Accordingly, a gate voltage of the first transistor M1 may be initialized to the voltage of the initialization power Vint by the turn-on of the seventh transistor M7, and the first transistor M1 may have an on-bias state (that is, the first transistor M1 may be initialized to the on-bias state).

The eighth transistor M8 may be connected between the initialization power Vint and the fourth node N4. According to some example embodiments, a gate electrode of the eighth transistor M8 may be connected to the i-th emission control line Ei.

According to some example embodiments, the eighth transistor M8 may be an N-type transistor. For example, the eighth transistor M8 may be an N-type oxide semiconductor transistor.

The eighth transistor M8 may be turned on when the emission control signal is supplied to the emission control line Ei and turned off in other cases. That is, the eighth transistor M8, which is an N-type transistor, may be turned on or turned off inversely to the fifth and sixth transistors M5 and M6.

The eighth transistor M8 is turned on when the emission control signal is supplied (that is, in a non-emission period) to supply the voltage of the initialization power Vint to the first electrode of the light emitting element LD.

When the voltage of the initialization power Vint is supplied to the first electrode of the light emitting element LD, a parasitic capacitor of the light emitting element LD may be discharged. As a residual voltage charged in the parasitic capacitor is discharged (removed), instances of unintended micro emission may be prevented or reduced. Therefore, a black expression capability of the pixel 10 may be improved.

According to some example embodiments, the fourth and seventh transistors M4 and M7 may be N-type oxide semiconductor transistors. Accordingly, a gate-on voltage for turning on the fourth and seventh transistors M4 and M7 may be a high voltage (logic high level).

The oxide semiconductor transistors are capable of a low temperature process and have lower charge mobility in comparison with a polysilicon semiconductor transistor. That is, the oxide semiconductor transistor is excellent in an off current characteristic. Therefore, when the fourth transistor M4, the seventh transistor M7, and the eighth transistor M8 are formed of oxide semiconductor transistors, a leakage current from the second node N2 and the fourth node N4 may be minimized, and thus display quality may be improved.

Meanwhile, as the transistors of the different types are located in the pixel 10, the scan drivers for outputting scan signals for controlling the transistors are required. For example, a conventional display device includes a scan driver for controlling a P-type transistor, a scan driver for controlling an N-type transistor, and an emission driver for supplying an emission control signal. That is, because the conventional display device controls the pixel using at least three drivers (the scan drivers and the emission driver), a dead space and power consumption for a disposition and an operation of the drivers may be increased.

However, the display device including the pixel 10 according to some example embodiments of the disclosure may control the second and third transistors M2 and M3 used for writing the data signal and the eighth transistor M8 used for initialization of the light emitting element LD by using the emission control signal, and may control the fourth and seventh transistors M4 and M7 by using the scan signal output from one scan driver 200 of FIG. 1.

Therefore, a scan driver configuration for driving the P-type transistor may be omitted, and the dead space and the power consumption of the display device 1000 may be greatly reduced.

Figure 4:
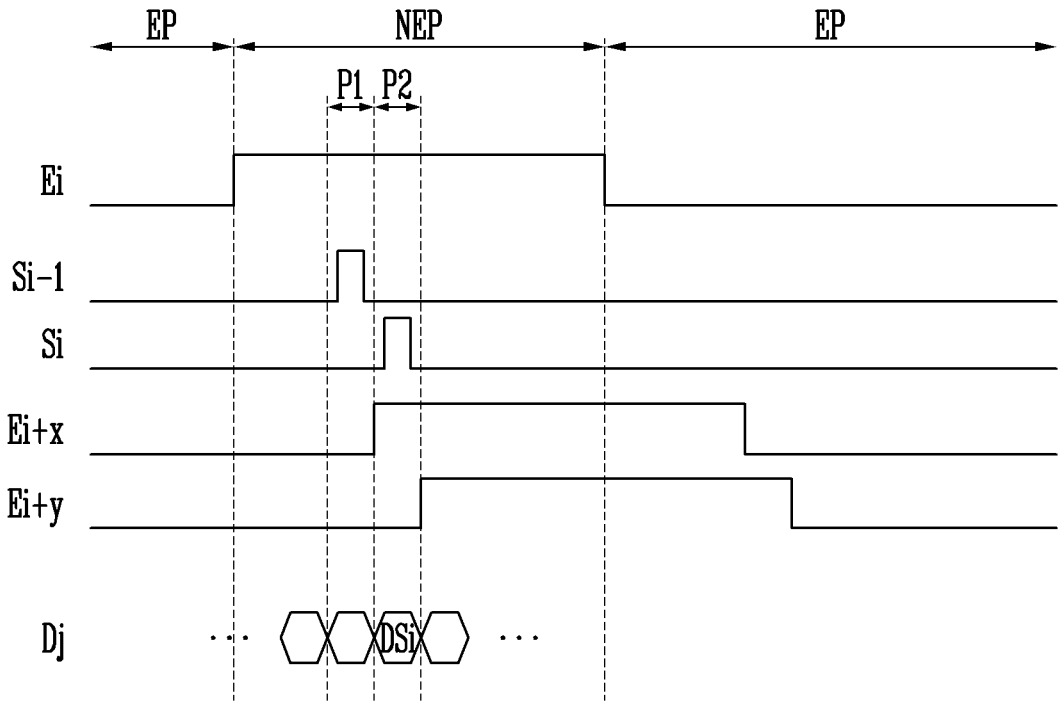
FIG. 4 is a timing diagram illustrating an example of driving of the pixel of FIG. 3.

FIG. 4 is a timing diagram illustrating an example of driving of the pixel of FIG. 3.

Referring to FIGS. 3 and 4, the pixel 10 may be operated by being divided into an emission period EP and a non-emission period NEP.

When the display device 1000 of FIG. 1 is driven at the first driving frequency, the pixel 10 may receive the scan signal and the emission control signal at the first driving frequency.

Meanwhile, when the display device 1000 is driven at the second driving frequency lower than the first driving frequency, the pixel 10 may receive the scan signal at the second driving frequency.

A period in which the emission control signal is supplied to the i-th emission control line Ei (that is, a period in which the high voltage of the emission control signal is supplied) is the non-emission period NEP of the pixel 10. A period in which the emission control signal is not supplied to the i-th emission control line Ei (that is, a period in which a low voltage of the emission control signal is supplied) is the emission period EP of the pixel 10.

In the non-emission period NEP, the fifth and sixth transistors M5 and M6 are turned off by the emission control signal, and thus the pixel 10 does not emit light.

In addition, in the non-emission period NEP, the eighth transistor M8 may be turned on in response to the emission control signal to supply the voltage of the initialization power Vint to the fourth node N4. Accordingly, the parasitic capacitor of the light emitting element LD may be discharged.

Meanwhile, the non-emission period NEP may include a first period P1 and a second period P2.

According to some example embodiments, the emission control signal may be supplied to the (i+x)-th emission control line Ei+x after being supplied to the i-th emission control line Ei. In addition, the emission control signal may be supplied to the (i+y)-th emission control line Ei+y after being supplied to the (i+x)-th emission control line Ei+x. For example, x may be 4 (that is, an (i+4)-th emission control line Ei+4), and y may be 5 (that is, an (i+5)-th emission control line Ei+5). The emission control signal supplied to the (i+4)-th emission control line Ei+4 may be a signal obtained by shifting the emission control signal supplied to the i-th emission control line Ei by 4 horizontal periods. However, this is merely an example, and the emission control lines connected to the second and third transistors M2 and M3 are not limited thereto.

In the first period P1, the scan signal may be supplied to the (i−1)-th scan line Si−1. In the second period P2, the scan signal may be supplied to the i-th scan line Si. Here, the scan signal has a high voltage as a signal for controlling the N-type transistors.

The seventh transistor M7 may be turned on in response to the scan signal supplied to the (i−1)-th scan line Si−1 in the first period P1. When the seventh transistor M7 is turned on, the voltage of the initialization power Vint may be supplied to the second node N2. Accordingly, the gate voltage of the first transistor M1 may be initialized and the first transistor M1 may be on-biased. Therefore, the first period P1 may be an initialization period.

According to some example embodiments, the emission control signal is not supplied to the (i+x)-th emission control line Ei+x and the (i+y)-th emission control line Ei+y in the first period P1. Therefore, in the first period P1, the second transistor M2 may be turned off and the third transistor M3 may be turned on. Accordingly, the data line Dj and the first node N1 are not electrically connected to each other.

The fourth transistor M4 may be turned on in response to the scan signal supplied to the i-th scan line Si in the second period P2. In addition, in the second period P2, the emission control signal is supplied to the (i+x)-th emission control line Ei+x and the emission control signal is not supplied to the (i+y)-th emission control line Ei+y. Therefore, both of the second and third transistors M2 and M3 may be turned on in the second period P2.

Because all of the second to fourth transistors M2 to M4 are turned on in the second period P2, the first transistor M1 may be connected in a diode form. When the second and third transistors M2 and M3 are turned on, the data line Dj and the first node N1 may be electrically connected to each other, and a data signal DSi may be supplied from the data line Dj to the first node N1. When the fourth transistor M4 is turned on, the second node N2 and the third node N3 may be electrically connected to each other, and thus a threshold voltage of the first transistor M1 may be compensated. That is, the second period P2 may be a data writing and threshold voltage compensation period.

Thereafter, the emission control signal may be supplied to the (i+y)-th emission control line Ei+y, and thus the third transistor M3 may be turned off. Therefore, the storage capacitor Cst may maintain a state in which the data signal DSi supplied in the second period P2 is stored.

Thereafter, supply of the emission control signal to the emission control line Ei is stopped. When the supply of the emission control signal to the emission control line Ei is stopped, the fifth and sixth transistors M5 and M6 are turned on. In addition, the eighth transistor M8 is turned off. At this time, the first transistor M1 controls the driving current flowing to the light emitting element LD in correspondence with the voltage of the second node N2. Then, the light emitting element LD may generate light of a luminance corresponding to the amount of current and emit light during the emission period EP.

During the emission period EP, the supply of the emission control signal to the (i+x)-th emission control line Ei+x and the (i+y)-th emission control line Ei+y may be sequentially stopped. However, because at least one of the second transistor M2 or the third transistor M3 is turned off during the emission period EP, the data line Dj and the first node N1 are not electrically connected to each other during the emission period EP.

As described above, because the second and third transistors M2 and M3 that transfer the data signal DSi to the first node N1 of the pixel 10 are controlled by the emission control signal, a configuration of the scan driver for control of the P-type transistor may be removed. Therefore, the dead space and the power consumption of the display device 1000 of FIG. 1 may be reduced.

Meanwhile, only the emission control signal may be periodically supplied to the pixel 10 during the second driving period T2 of FIG. 2B at the second driving frequency described with reference to FIG. 2B. Accordingly, the second and third transistors M2 and M3 may be simultaneously (or concurrently) turned on periodically during the second driving period T2 of FIG. 2B. When the second and third transistors M2 and M3 are simultaneously (or concurrently) turned on, the voltage of the reference power Vref may be supplied to the first node N1.

According to some example embodiments, the voltage of the reference power Vref may have a voltage level at which on-bias may be applied to the driving transistor of the pixel 10. By periodically on-biasing the first transistor M1 in the second driving period T2, a hysteresis characteristic of the first transistor M1 may be improved. Therefore, image flicker that may occur during low frequency driving may be improved.

Figure 5:
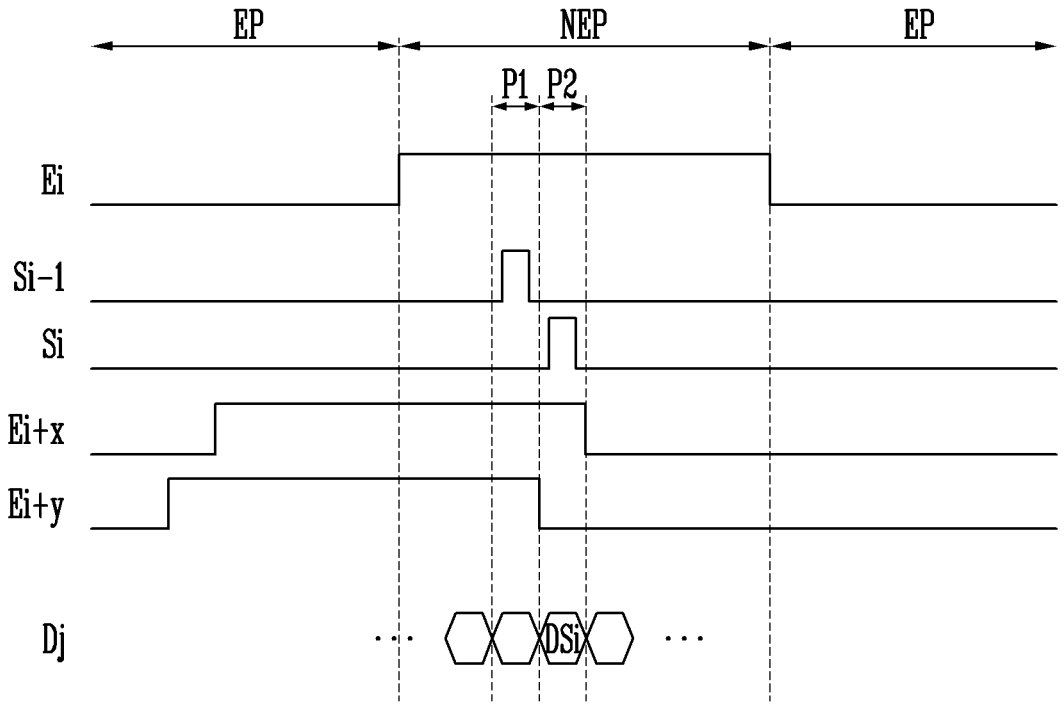
FIG. 5 is a timing diagram illustrating further details of an example of driving of the pixel of FIG. 3.

FIG. 5 is a timing diagram illustrating another example of driving of the pixel of FIG. 3.

The driving of the pixel of FIG. 5 is substantially the same as the driving method of FIG. 4 except for a timing of the emission control signal supplied to the (i+x)-th emission control line and the (i+y)-th emission control line connected to the pixel, and thus some repetitive description may be omitted.

Referring to FIGS. 3 and 5, the emission control signal may be supplied to the (i+x)-th emission control line Ei+x after being supplied to the (i+y)-th emission control line Ei+y. In addition, the emission control signal may be supplied to the i-th emission control line Ei after being supplied to the (i+x)-th emission control line Ei+x.

For example, x may be −4 (that is, an (i−4)-th emission control line Ei−4), and y may be −5 (that is, an (i−5)-th emission control line Ei−5). However, this is merely an example, and the emission control lines connected to the second and third transistors M2 and M3 are not limited thereto.

The second and third transistors M2 and M3 may be simultaneously (or concurrently) turned on during the second period P2. That is, a period in which the emission control signal is supplied to the (i+x)-th emission control line Ei+x and the emission control signal is not supplied to the (i+y)-th emission control line Ei+y may overlap the second period P2.

In periods except for the second period P2, because the second and third transistors M2 and M3 are not simultaneously (or not concurrently) turned on, an operation substantially the same as the driving of FIG. 4 may be performed.

Figure 6:
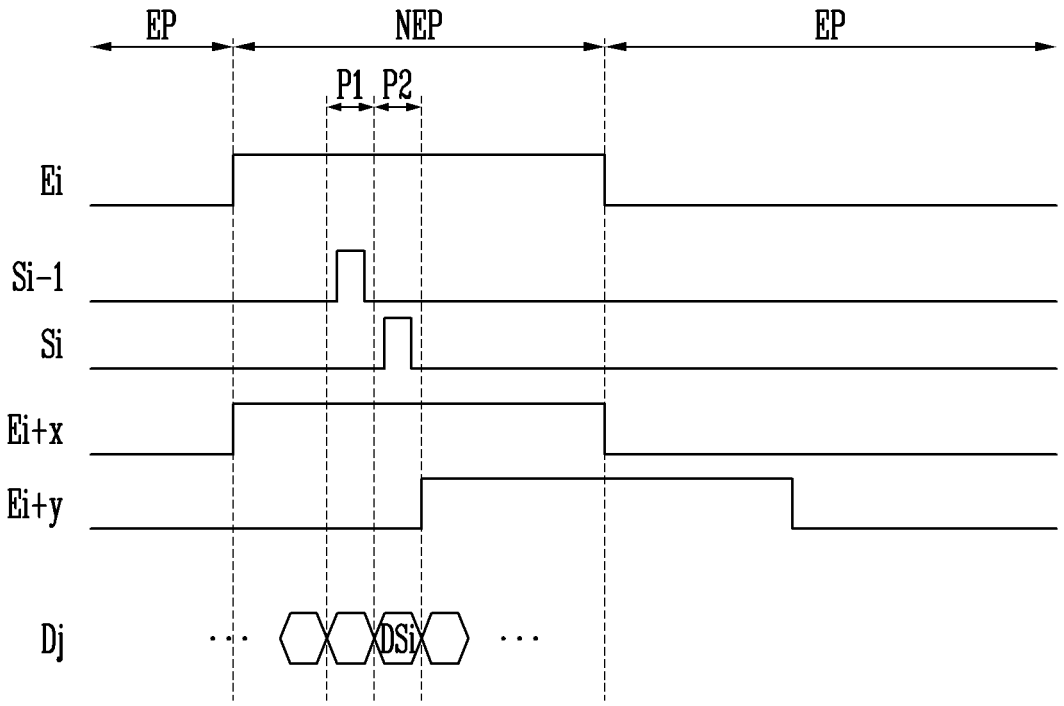
FIG. 6 is a timing diagram illustrating further details of an example of driving of the pixel of FIG. 3.

FIG. 6 is a timing diagram illustrating still another example of driving of the pixel of FIG. 3.

The driving of the pixel of FIG. 6 is substantially the same as the driving method of FIG. 4 except for the timing of the emission control signal supplied to the (i+x)-th emission control line and the (i+y)-th emission control line connected to the pixel, and thus some repetitive description may be omitted.

Referring to FIGS. 3 and 6, the emission control signal may be supplied to the (i+y)-th emission control line Ei+y after being supplied to the (i+x)-th emission control line Ei+x.

According to some example embodiments, the gate electrode of the second transistor M2 may be connected to the i-th emission control line Ei. That is, x may be zero. At this time, the (i+y)-th emission control line Ei+y may be an emission control line to which the emission control signal is supplied after the second period P2. For example, y may be greater than zero and less than five. However, this is merely an example, and the emission control lines connected to the second and third transistors M2 and M3 are not limited thereto.

The second and third transistors M2 and M3 may be simultaneously turned on during the second period P2. That is, the period in which the emission control signal is supplied to the (i+x)-th emission control line Ei+x and the emission control signal is not supplied to the (i+y)-th emission control line Ei+y may overlap the second period P2. In addition, there may be a period in which the second and third transistors M2 and M3 are simultaneously (or concurrently) turned on even in a period before the second period P2 within the non-emission period NEP.

However, after the second period P2, the second and third transistors M2 and M3 are not simultaneously (or concurrently) turned on. For example, when the second period P2 elapses, the emission control signal may be supplied to the (i+y)-th emission control line Ei+y. Accordingly, an operation substantially the same as the driving of FIG. 4 may be performed.

As described above, the emission control lines connected to the gate electrodes of the respective second and third transistors M2 and M3 may be freely selected when the emission control lines correspond to an operation condition as shown in FIGS. 4 to 6. For example, during the second period P2, the emission control signal is required to be supplied to the (i+x)-th emission control line Ei+x (that is, the emission control signal of the high voltage is supplied), and the emission control signal is required not to be supplied to the (i+y)-th emission control line Ei+y (that is, the light emission control signal of the low voltage is supplied). In addition, at least one of the second transistor M2 or third transistor M3 may be turned off after the second period.

Figure 7:
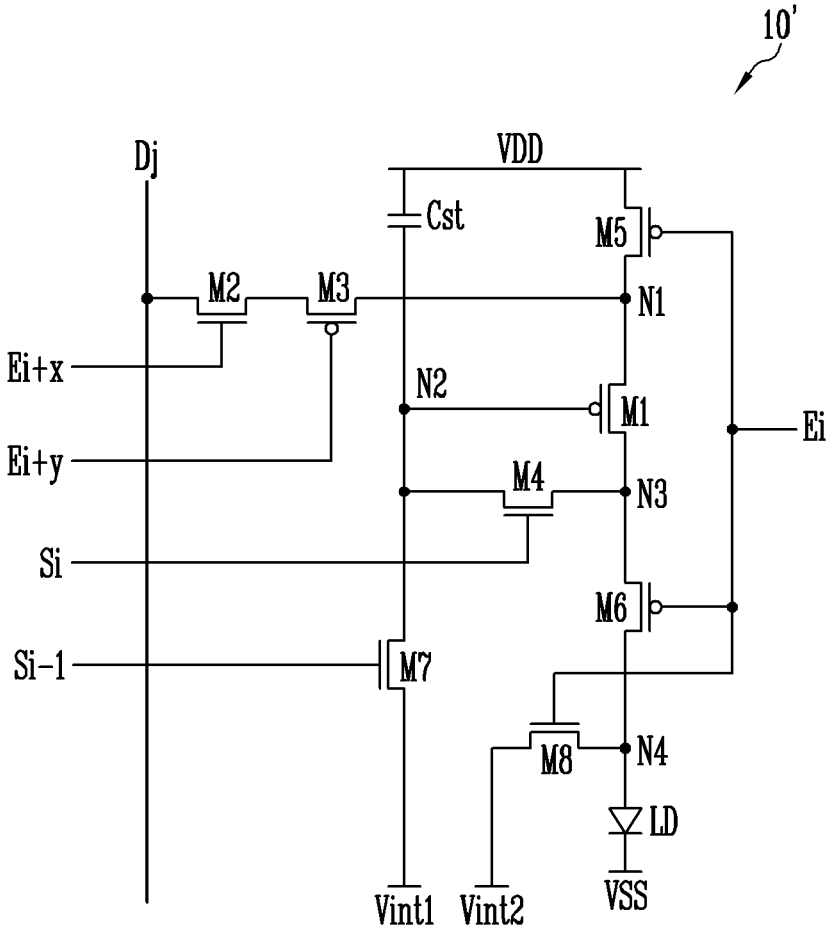
FIG. 7 is a circuit diagram illustrating an example of the pixel of FIG. 3.

FIG. 7 is a circuit diagram illustrating an example of the pixel of FIG. 3.

When describing FIG. 7, the same reference numerals are assigned to the same or similar components as those of FIG. 3, and some repetitive description may be omitted.

Referring to FIG. 7, the pixel 10' may include a light emitting element LD, first to eighth transistors M1 to M8, and a storage capacitor Cst.

The seventh transistor M7 is connected between the second node N2 and first initialization power Vint1. A gate electrode of the seventh transistor M7 is connected to the (i−1)-th scan line Si−1. The seventh transistor M7 is turned on when the scan signal is supplied to the (i−1)-th scan line Si−1 to supply a voltage of the first initialization power Vint to the second node N2.

The eighth transistor M8 may be connected between second initialization power Vint2 and the fourth node N4. According to some example embodiments, a gate electrode of the eighth transistor M8 may be connected to the i-th emission control line Ei.

The first initialization power Vint1 and the second initialization power Vint2 may generate different voltages. That is, a voltage for initializing the second node N2 and a voltage for initializing the fourth node N4 may be set differently.

In low frequency driving in which a length of the image refresh rate becomes long, when the voltage of the first initialization power Vint1 supplied to the second node N2 is excessively low, a hysteresis change of the first transistor M1 in a corresponding frame period is increased. Such hysteresis may cause flicker phenomenon in the low frequency driving. Therefore, in the display device of the low frequency driving, the voltage of the first initialization power Vint1, which is higher than the voltage of the second power VSS may be required.

However, when the voltage of the second initialization power Vint2 supplied to the fourth node N4 becomes higher than a reference (e.g., a set or predetermined reference), a voltage of the parasitic capacitor of the light emitting element LD may be charged rather than discharged. Therefore, the voltage of the second initialization power Vint2 is required to have a voltage lower than the reference (e.g., the set or predetermined reference). For example, the voltage of the second initialization power Vint2 may have a voltage similar to that of the second power VSS. However, this is merely an example, and the voltage of the second initialization power Vint2 may be higher or lower than the voltage of the second power VSS according to the driving condition of the display device.

That is, in order to improve driving performance of the pixel PXL, a voltage supplied to the second node N2 through the seventh transistor M7 and a voltage supplied to the fourth node N4 through the eighth transistor M8 may be set differently. Therefore, flicker and incorrect emission may be improved.

Figure 8:
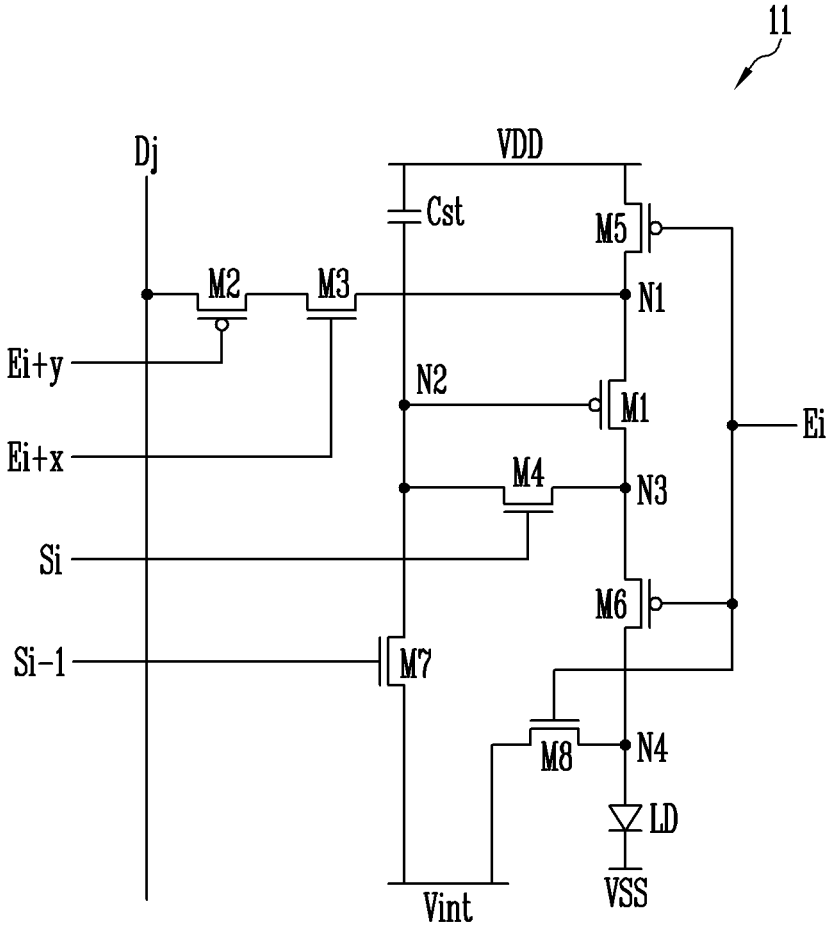
FIGS. 8 and 9 are circuit diagrams illustrating further details of a pixel according to some example embodiments.
Figure 9:
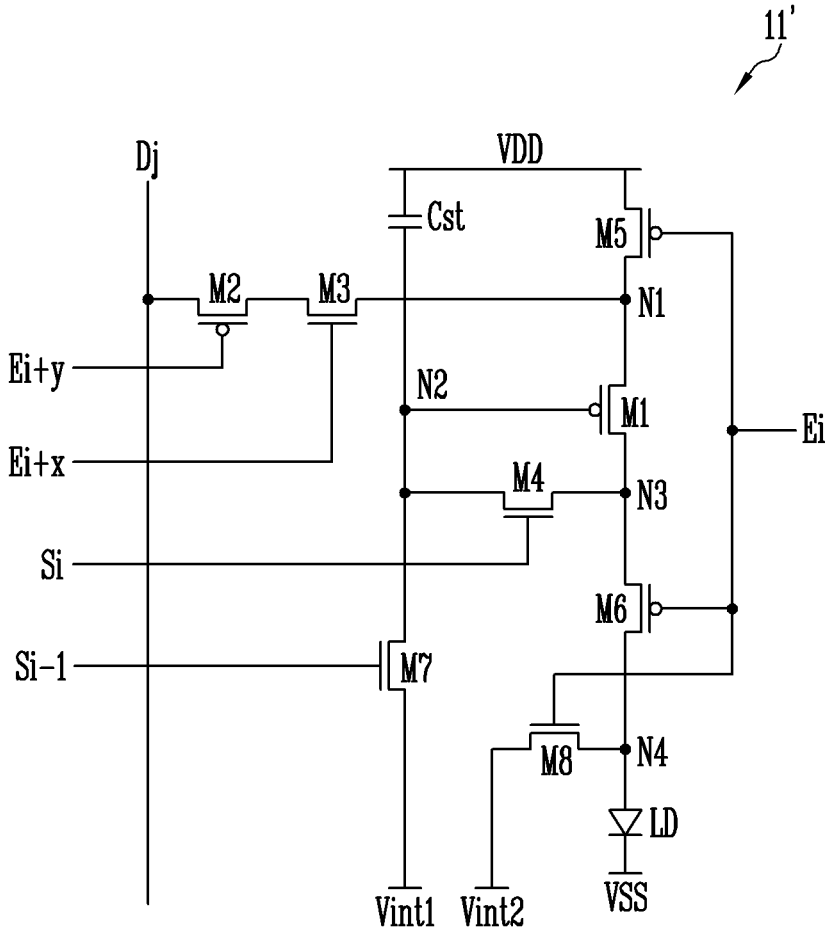

FIGS. 8 and 9 are circuit diagrams illustrating other examples of the pixel.

When describing FIGS. 8 and 9, the same reference numerals are assigned to the same or similar components as those of FIGS. 3 and 7, and some repetitive description may be omitted.

Referring to FIGS. 8 and 9, the pixels 11 and 11' may include a light emitting element LD, first to eighth transistors M1 to M8, and a storage capacitor Cst.

The second transistor M2 and the third transistor M3 may be connected in series between the data line Dj and the first node N1. The second transistor M2 and the third transistor M3 may be different types.

According to some example embodiments, the second transistor M2 may be a P-type polysilicon semiconductor transistor, and the third transistor M3 may be an N-type oxide semiconductor transistor.

A gate electrode of the second transistor M2 may be connected to one of the (i+y)-th emission control lines Ei+y shown in FIGS. 4 to 6. A gate electrode of the third transistor M3 may be connected to one of the (i+x)-th emission control lines Ei+x shown in FIGS. 4 to 6. Therefore, the pixels 11 and 11' may perform an operation substantially the same as the operation of the pixel 10 of FIG. 3.

Because the pixel 11 of FIG. 8 is the same as the pixel 10 of FIG. 3 except for a configuration of the second and third transistors M2 and M3, some repetitive description thereof may be omitted. In addition, because the pixel 11' of FIG. 9 is the same as the pixel 10' of FIG. 7 except for the configuration of the second and third transistors M2 and M3, some repetitive description thereof may be omitted.

Figure 10:
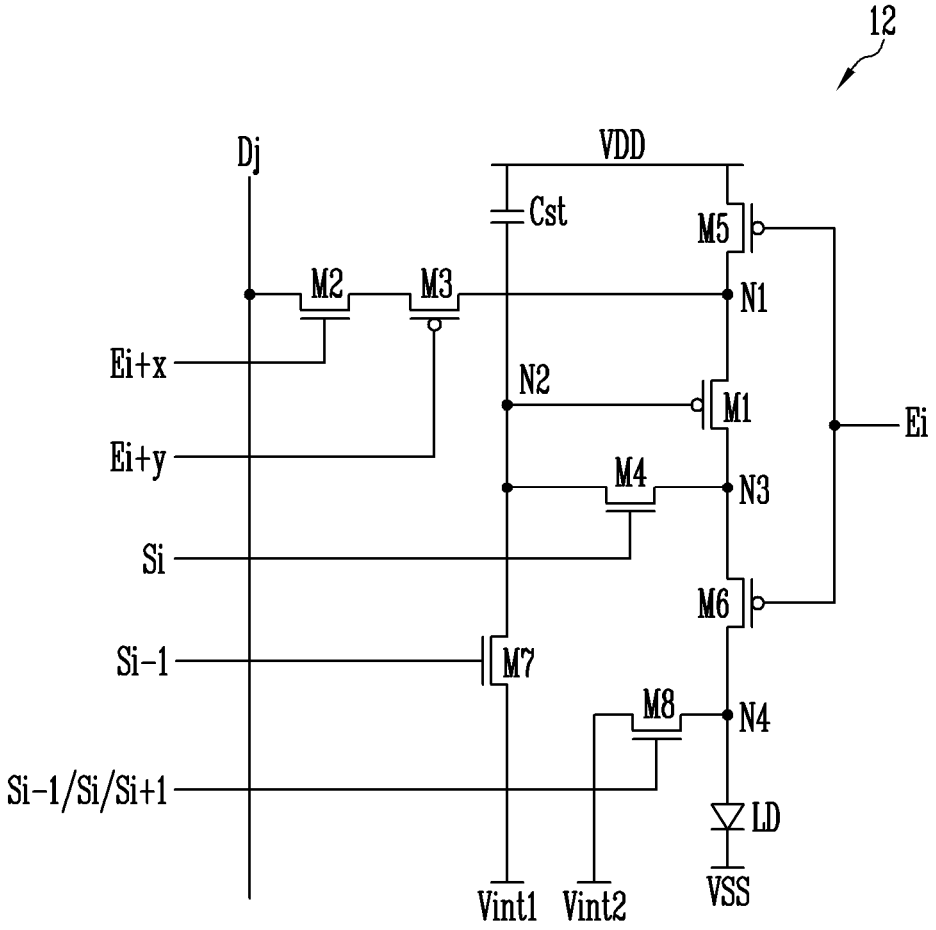
FIGS. 10 and 11 are circuit diagrams illustrating further details of a pixel according to some example embodiments.
Figure 11:
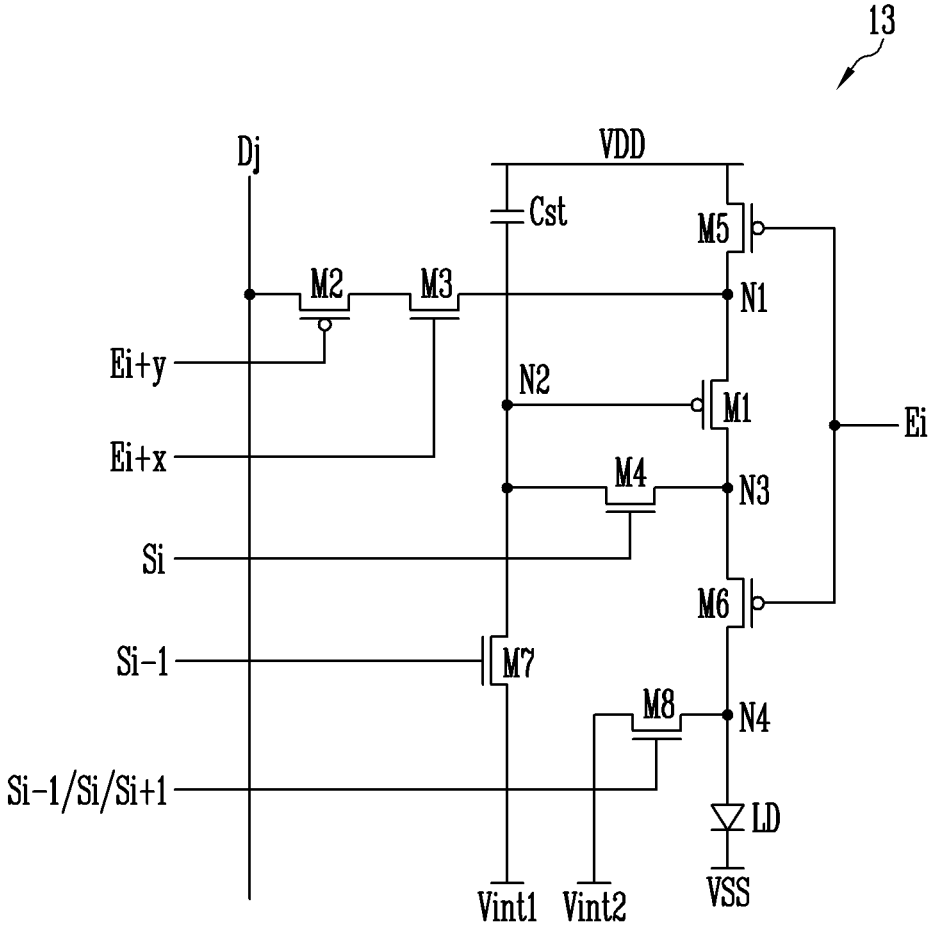

FIGS. 10 and 11 are circuit diagrams illustrating still another example of the pixel.

When describing FIGS. 10 and 11, the same reference numerals are assigned to the same or similar components as those of FIGS. 3 and 7, and some repetitive description may be omitted.

Referring to FIGS. 10 and 11, the pixels 12 and 13 may include a light emitting element LD, first to eighth transistors M1 to M8, and a storage capacitor Cst.

The eighth transistor M8 may be connected between the second initialization power Vint2 and the fourth node N4. According to some example embodiments, a gate electrode of the eighth transistor M8 may be connected to one of the (i−1)-th scan line Si−1, the i-th scan line Si, and the (i+1)-th scan line Si+1. Accordingly, the eighth transistor M8 may be turned on in response to the scan signal.

Because the pixel 12 of FIG. 10 is the same as the pixel 10' of FIG. 7 except for a configuration of the eighth transistor M8, some repetitive description thereof may be omitted. In addition, because the pixel 13 of FIG. 11 is the same as the pixel 11' of FIG. 9 except for the configuration of the eighth transistor M8, some repetitive description thereof may be omitted.

As described above, a pixel including N-type and P-type transistors, and the display device including the same according to some example embodiments of the disclosure may control the second and third transistors M2 and M3, which are used for writing the data signal, by using the emission control signal. Therefore, the scan driver configuration for driving the P-type transistor may be removed. Thus, the dead space and the power consumption of the display device may be greatly reduced.

Although the disclosure has been described with reference to the embodiments thereof, it will be understood by those skilled in the art that the disclosure may be variously corrected and changed without departing from the spirit and scope of embodiments according to the disclosure as defined in the following claims and their equivalents.

What is claimed is:

1. A display device comprising:

pixels connected to scan lines, emission control lines, and data lines;

a scan driver configured to supply scan signals to the scan lines;

an emission driver configured to supply emission control signals to the emission control lines; and a data driver configured to supply data signals to the data lines in correspondence with the scan signals, wherein a pixel in an i-th (where, i is an integer greater than 0) horizontal line among the pixels comprises:

a light emitting element;

a first transistor including a first electrode connected to a first node electrically connected to a first power, and configured to control a driving current based on a voltage of a second node;

a second transistor including a gate electrode connected to an (i+x)-th (where, x is an integer) emission control line and connected to one of the data lines;

a third transistor including a gate electrode connected to an (i+y)-th (where, y is an integer that is not zero and different from x) emission control line, and connected between the second transistor and the first node;

a fourth transistor connected between a third node connected to a second electrode of the first transistor and the second node, and configured to be turned on by a scan signal supplied to an i-th scan line; and a fifth transistor connected between the first power and the first node, and configured to be turned off by an emission control signal supplied to an i-th emission control line, and wherein at least one of emission control signals supplied to the (i+x)-th emission control line and the (i+y)-th emission control line is a signal shifted from the emission control signal supplied to the i-th emission control line, and wherein the (i+x)-th emission control line is also connected to a gate electrode of a fifth transistor of a pixel in an (i+x)-th horizontal line.

2. The display device according to claim 1, wherein the second transistor and the third transistor are different types.

3. The display device according to claim 2, wherein the second transistor is an N-type transistor including an oxide semiconductor layer, and the third transistor is a P-type transistor including a polysilicon semiconductor layer.

4. The display device according to claim 3, wherein the second transistor is configured to be turned on by an emission control signal supplied to the (i+x)-th emission control line, and the third transistor is configured to be turned off by an emission control signal supplied to the (i+y)-th emission control line.

5. The display device according to claim 4, wherein the emission driver is configured to supply the emission control signal to the (i+x)-th emission control line after supplying the emission control signal to the i-th emission control line, and to supply the emission control signal to the (i+y)-th emission control line after supplying the emission control signal to the (i+x)-th emission control line.

6. The display device according to claim 4, wherein the emission driver is configured to supply the emission control signal to the (i+x)-th emission control line after supplying the emission control signal to the (i+y)-th emission control line, and to supply the emission control signal to the i-th emission control line after supplying the emission control signal to the (i+x)-th emission control line.

7. The display device according to claim 4, wherein the emission driver is configured to simultaneously supply the emission control signal to the i-th emission control line and the (i+x)-th emission control line, and to supply the emission control signal to the (i+y)-th emission control line after supplying the emission control signal to the (i+x)-th emission control line.

8. The display device according to claim 2, wherein the pixel positioned in the i-th horizontal line further comprises:

a sixth transistor connected between the third node and a first electrode of the light emitting element, and configured to be turned off by the emission control signal supplied to the i-th emission control line; and a seventh transistor connected between the second node and a first initialization power, and configured to be turned on by a scan signal supplied to an (i-1)-th scan line.

9. The display device according to claim 8, wherein the pixel positioned in the i-th horizontal line further comprises:

an eighth transistor coupled between a second initialization power and the first electrode of the light emitting element, and configured to be turned on by the emission control signal supplied to the i-th emission control line.

10. The display device according to claim 9, wherein the fourth, seventh, and eighth transistors are N-type transistors including an oxide semiconductor layer, and the fifth and sixth transistors are p-type transistors including a polysilicon semiconductor layer.

11. The display device according to claim 2, wherein the second transistor is a P-type transistor including a polysilicon semiconductor layer, and the third transistor is an N-type transistor including an oxide semiconductor layer.

12. A pixel comprising:

a light emitting element;

a first transistor including a first electrode connected to a first node electrically connected to a first power, and configured to control a driving current based on a voltage of a second node;

a second transistor including a gate electrode connected to a first emission control line and connected to a data line;

a third transistor including a gate electrode connected to a second emission control line, and connected between the second transistor and the first node;

a fourth transistor connected between a third node connected to a second electrode of the first transistor and the second node, and configured to be turned on by a scan signal supplied to a first scan line;

a fifth transistor connected between the first power and the first node, and configured to be turned off by an emission control signal supplied to a third emission control line;

a sixth transistor connected between the third node and a first electrode of the light emitting element, and configured to be turned off by the emission control signal supplied to the third emission control line; and a storage capacitor connected between the first power and the second node, wherein a data signal is supplied to the first transistor through the data line as the second transistor, the third transistor, and the fourth transistor are configured to be simultaneously turned on.

13. The pixel according to claim 12, wherein the second transistor and the third transistor are different types.

14. The pixel according to claim 13, wherein the second transistor is an N-type transistor including an oxide semiconductor layer, and the third transistor is a P-type transistor including a polysilicon semiconductor layer.

15. The pixel according to claim 14, wherein the second transistor is configured to be turned on by an emission control signal supplied to the first emission control line, and the third transistor is configured to be turned off by an emission control signal supplied to the second emission control line.

16. The pixel according to claim 13, further comprising:

a seventh transistor connected between the second node and a first initialization power, and configured to be turned on by the scan signal supplied to a second scan line.

17. The pixel according to claim 16, further comprising:

an eighth transistor coupled between a second initialization power and the first electrode of the light emitting element, and configured to be turned on by the emission control signal supplied to the third emission control line, wherein the eighth transistor is an N-type transistor including an oxide semiconductor layer, and the fifth and sixth transistors are P-type transistors including a polysilicon semiconductor layer.

18. The pixel according to claim 17, wherein the fourth and seventh transistors are the N-type transistors.

19. The pixel according to claim 16, further comprising:

an eighth transistor coupled between a second initialization power and the first electrode of the light emitting element, and configured to be turned on by the scan signal supplied to the first scan line or the second scan line.

* * * * *